US006397562B1

(12) United States Patent
Herrhammer

(10) Patent No.: US 6,397,562 B1
(45) Date of Patent: Jun. 4, 2002

(54) PROCESS AND DEVICE FOR PRODUCING A CANDLE SURROUNDED BY A CONTAINER

(75) Inventor: Peter Herrhammer, Ochsenfurt (DE)

(73) Assignee: Spezialmaschinenbau Herrhammer GmbH, Ochsenfurt (DE)

( * ) Notice: Subject to any disclaimer, the term of this patent is extended or adjusted under 35 U.S.C. 154(b) by 0 days.

(21) Appl. No.: 09/468,828

(22) Filed: Dec. 22, 1999

(30) Foreign Application Priority Data

Dec. 23, 1998 (DE) ..... 198 60 059

(51) Int. Cl.[7] ..... B65B 55/14

(52) U.S. Cl. ..... 53/440; 53/428; 53/127; 53/122; 53/239; 53/235; 53/237; 362/161; 362/447; 431/291; 431/325; 431/288

(58) Field of Search ..... 53/440, 428, 474, 53/127, 122, 239, 155; 425/112, 116, 803; 431/291, 325, 288; 362/161, 447; 156/309.9, 294

(56) References Cited

U.S. PATENT DOCUMENTS 1,174,934 A * 3/1916 Hawkins et al.
3,998,922 A * 12/1976 Weiss ..... 264/255
4,096,298 A * 6/1978 Menig ..... 427/262
6,033,210 A * 3/2000 Freeman ..... 431/291
6,068,472 A * 5/2000 Freeman et al. ..... 431/291

FOREIGN PATENT DOCUMENTS

DE 3620607 A1 * 4/1987 ..... 364/271.1
WO WO 87/03004 5/1987

* cited by examiner

*Primary Examiner*—Rinaldi I. Rada
*Assistant Examiner*—Thanh K. Truong
(74) *Attorney, Agent, or Firm*—Nixon Peabody LLP; David S. Safran

(57) ABSTRACT

Process for producing a candle surrounded by a container in which a prefabricated candle blank which does not completely fill the interior of the container is inserted and fixed in the container. An intermediate space between the candle blank and the inside wall of the container is then filled with liquid candle material and the container which has been filled in this way is allowed to cool. In order to be able to fix the inserted candle blank stationary in the container, before insertion into the container, the candle blank is heated on its bottom and its bottom which has become sticky in this way is located on the bottom of the container. The candle blank is immediately fixed in its position by releasing the heat of the heated bottom to the container bottom.

4 Claims, 3 Drawing Sheets

PROCESS AND DEVICE FOR PRODUCING A CANDLE SURROUNDED BY A CONTAINER

BACKGROUND OF THE INVENTION

1. Field of the Invention

The invention relates to a process for producing a candle surrounded by a container, in which a prefabricated candle blank is used which does not completely fill the interior of the container, the intermediate space between the candle blank and the inside wall of the container being filled with liquid candle material, and the container which has been filled in this way is allowed to cool, and a device for executing this process.

2. Description of Related Art

Production of a candle surrounded by a container or a container filled with a candle material, such as candle wax, for example, a glass, a shell or a mold, when the container is filled with liquid wax, as a result of the heat energy present during filling, requires a longer time for cooling of the wax to room temperature for the product to be ready for packaging. For larger candles, i.e., wax blanks which are to be provided with wicks at a later time, this time interval can be up to a few hours. For this reason a process for producing a candle surrounded by a container in which the container is filled with liquid wax is very time-consuming and also very space-intensive for larger numbers of products.

To reduce the time consumption and the space requirement, it has already been suggested that the container be filled with pasty wax or paraffin. However, the defect of this alternative is that the corresponding system is very costly and the insertion and centering of the wick necessitate considerable technical effort which is likewise associated with high costs.

To avoid this, a process for producing a candle surrounded by a container has been developed in which a prefabricated candle blank is inserted into the container and does not completely fill the container interior, the container is subsequently filled with liquid wax until the candle blank is no longer visible, and the filled container is then allowed to cool.

To fix the candle blank in the container in the required manner, a hot-setting cement is used which is injected into the container before inserting the candle blank. The candle blank is then placed on this still liquid hot-setting cement, so that it adheres securely on the container bottom. It is also possible to coat the bottom of the container with a thin layer of liquid paraffin and at the time at which this paraffin begins to harden, i.e., is in the pasty state, to insert the candle blank.

The disadvantage in this process is the fact that, to inject the hot-setting cement, a corresponding hot-setting adhesive device is necessary which can work only with special cements which are associated with high costs. When the liquid paraffin is added, on the other hand, there is the disadvantage that, for insertion of the candle blank, a quite specific instant must be awaited since, when the candle blank is inserted too early, it is not centered and slips, and when inserted too late, the paraffin has already solidified to such an extent that the candle blank can no longer be fixed.

SUMMARY OF THE INVENTION

The primary object of the present invention is, conversely, to configure the process of the initially mentioned type such that the defects which occur in the known processes are avoided, i.e., especially with low cost and with high reliability, is it ensured that the candle blank is located securely in the required manner in the container.

This object is achieved in accordance with the invention by the candle blank being heated on its bottom before it is inserted into the container and is located with the heated bottom on the bottom of the container.

The subject matter of the invention is furthermore a device for implementing the process in accordance with the invention, in which means for supplying empty containers and candle blanks to a position at which the candle blanks are inserted into the empty containers are provided along with a heating means which is arranged such that it heats the bottom of the candle blanks as they are feed but before they reach the position for insertion into the containers.

In the following, especially preferred embodiments of the invention are explained using the accompanying drawings.

DETAILED DESCRIPTION OF THE INVENTION

Figure 1:
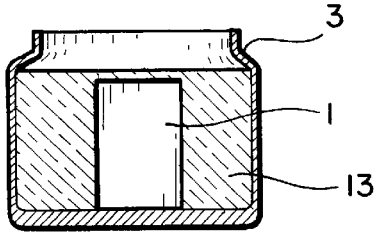
FIG. 1 is a sectional view of a candle surrounded by a container.

In the sectional view of FIG. 1, a candle is shown surrounded by a container 3, which has been produced by having placed a candle blank 1 centered in the container 3 and then having filled the container 3 with liquid wax 13 to such an extent that the candle blank 1 is no longer visible in the container 3. The container 3 which has been filled in this way was then allowed to cool.

The arrangement of the candle blank 1 which has dimensions such that it does not fully occupy the interior of the container 3 proceeds such that the candle blank 1 is heated on its bottom before it is inserted into the container 3 so that its base area becomes sticky. When the candle blank 1 with its sticky base area is then inserted into the container 3, the heat on the base area of the candle blank 1 is immediately dissipated to the much cooler container 3, i.e., to its bottom. This causes adhesion of the candle blank 1 to the container bottom via the heat inherent in the base area of the candle blank.

Preferably, heating of the bottom of the candle blank 1 takes place by hot air or another heating medium, or by means of a heating plate via which the bottom of the candle blank 1 is routed past before insertion into the container 3, such that it is heated and acquires a sticky texture.

The candle blank 1, with its heated and sticky bottom, is then inserted into the container 3, whereupon the intermediate space between the candle blank 1 and the inside wall of the container 3 is filled with liquid candle material 13, especially liquid wax or liquid paraffin. The container 3 filled in this way is then allowed to cool until a product ready for packaging results.

As a result of using a prefabricated candle blank, the time necessary to cool the filled container is much less than is the case when the container is completely filled with liquid candle material. The candle blank 1 is fixed in the container 3 without using additional means, especially without using cements or additional paraffin layers alone by heating the bottom of the candle blank 1; this represents a simple process which is associated with low costs.

Figure 4:
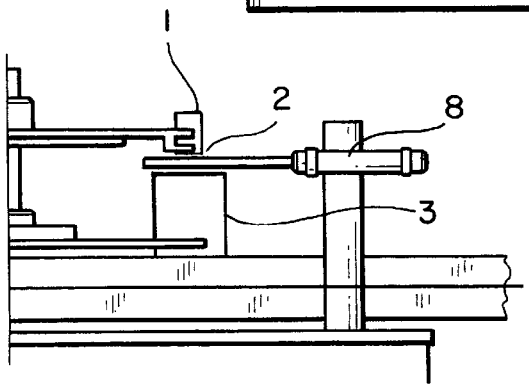
FIG. 4 is a sectional view taken along line 4—4 in FIG. 3.
Figure 3:
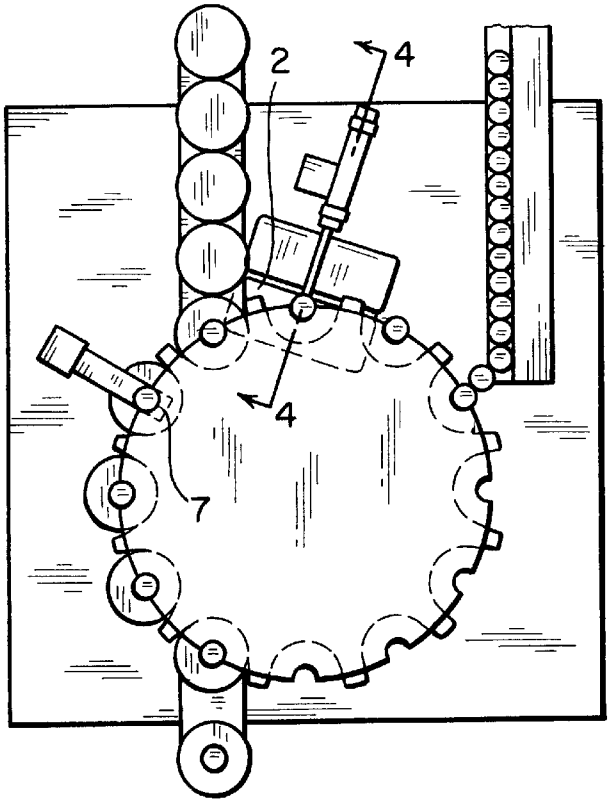
FIG. 3 is a plan view of the device which is shown in FIG. 2.
Figure 2:
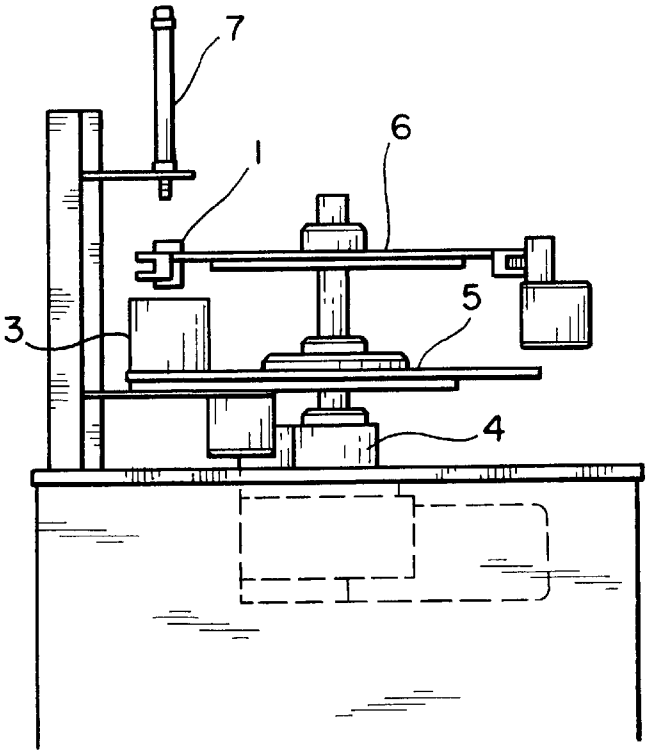
FIG. 2 is a side view of a device for producing the candle which is shown in FIG. 1.

FIGS. 2 to 4 show a first embodiment of a device for executing the above described process.

As is shown in FIG. 2, the device essentially comprises a rotary indexing table 4 with two planes. In the first plane is a centering disk 5 into which are inserted empty containers 3 which assume certain positions when the rotary indexing table 4 is rotationally cycled. In the second plane, which lies over the first plane, there is a disk 6 for holding the candle blanks 1 which is arranged coaxially with respect to the centering disk 5. As is shown in FIG. 3, and especially in FIG. 4, there is a heating plate 2 at that location at which the rotary indexing table 4, i.e., especially the disk 6, guides the candle blank 1 over the heating plate 2 such that the base of the candle blank 1 is melted before it is inserted into the container 3. The subsequent insertion of the candle blank 1 with the base heated in this way, i.e., melted, takes place in one of the next stations of the rotary indexing table 4 via a cylinder 7 which presses the candle blank 1 into the container 3. The candle blank 1 is thus immediately joined firmly to the container bottom.

Furthermore, FIG. 3 shows two linear supply and removal arrangements for the empty containers 3 and the filled containers.

FIG. 4 shows, in a sectional view, the structure of the station at which the bottoms of the candle blanks 1 are heated.

As is shown in FIG. 4, the heating plate 2 in the path of the candle blanks 1 which are located in the disk 6 and is arranged such that the bottoms of candle blanks 1 run over the heating plate 2. The heating plate 2 is joined to a pneumatic carriage 8 via which the heating plate 2 can be withdrawn, from its working position on the bottom of the candle blank 1 when for melting of the base of the candle blank, to prevent further melting once the candle bottom has been sufficiently melted. Then, the heating plate 2 is pushed forward again by the pneumatic carriage 8 and is cycled to the next candle blank 1 to heat its bottom.

Instead of a rotary indexing table, there can also be linearly formed means for supplying of containers and candle blanks. Several containers and candle blanks can be supplied at the same time to increase the production number.

Figure 5:
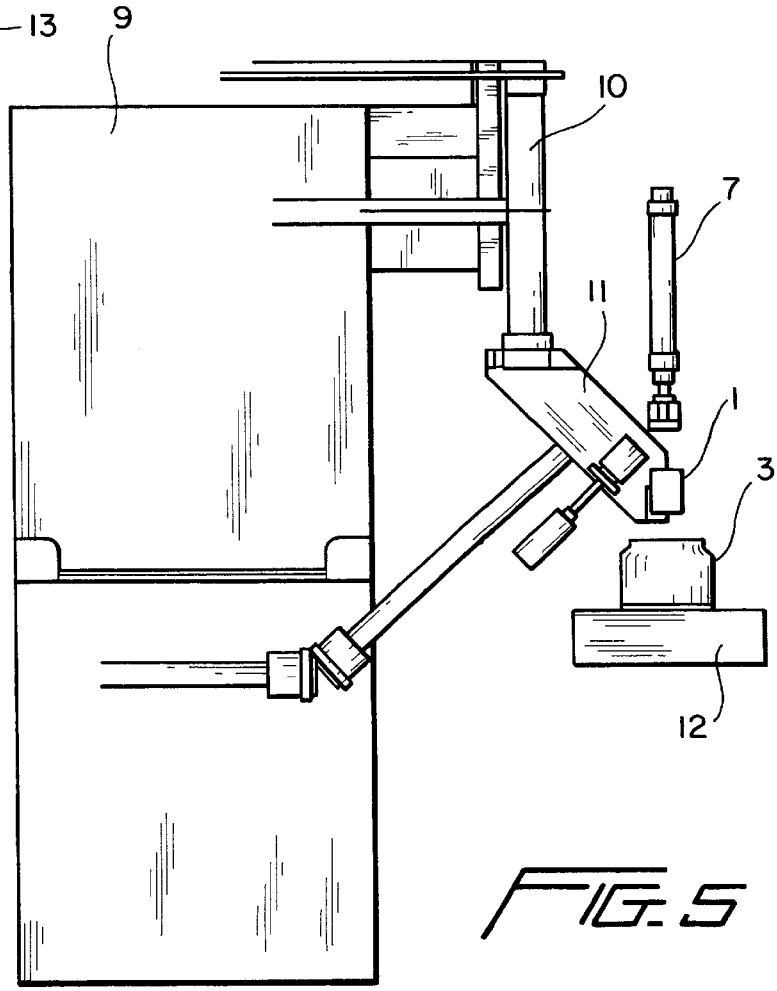
FIG. 5 is a schematic side view of another embodiment of the device in accordance with the invention.

FIG. 5 shows in a schematic representation another embodiment of the device in accordance with the invention in which the candle blanks 1 are inserted directly into a wick-plate mounting machine 9. The candle blanks or candles 1 are inserted directly from a mounting wheel 10 for wicks and plates, via an assembly wheel 11, into the containers 3 which are cycled past under the assembly wheel 11, preferably on a transport belt 12. Each candle blank 1 is held in a holding receiver at the periphery of the wheel 11 that applies a clamping force the side of the candle blank that is just sufficient to hold it in place as the wheel is rotated, but which is open at the top and bottom ends of the candle blank 1.

The candle blanks 1 are carried by the wheel 11 as the wheel 11 is stepwise rotated, and when each blank reaches a position which is one or two steps from the insertion position, the bottom of the candle blank 1 is brought over heating means 2. When the candle blank reaches the insertion position above the container 3, a pusher 7 presses the candle blank 1 from the holding receiver of the assembly wheel 11 and presses the candle blank 1 with its melted bottom against the bottom wall of the container 3. The container 3 with the candle blank 1 affixed to its bottom wall is then transported by the container belt 12 to a filling station where the intermediate space between the container 3 and the candle blank 1 is filled with liquid candle material.

Figure 7:
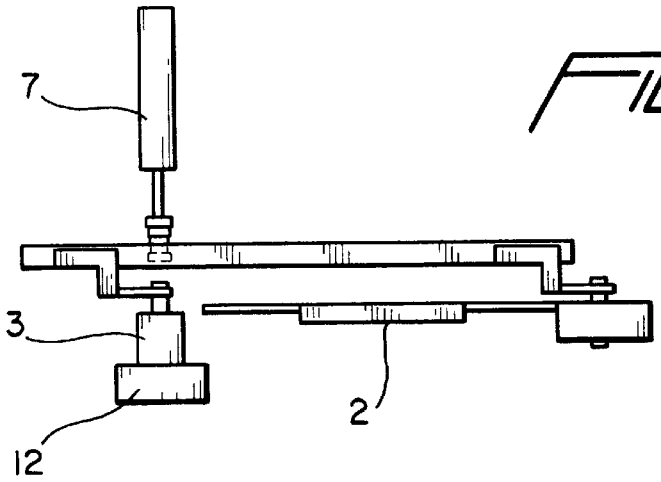
FIG. 7 shows a side view of the embodiment which is shown in FIG. 6.
Figure 6:
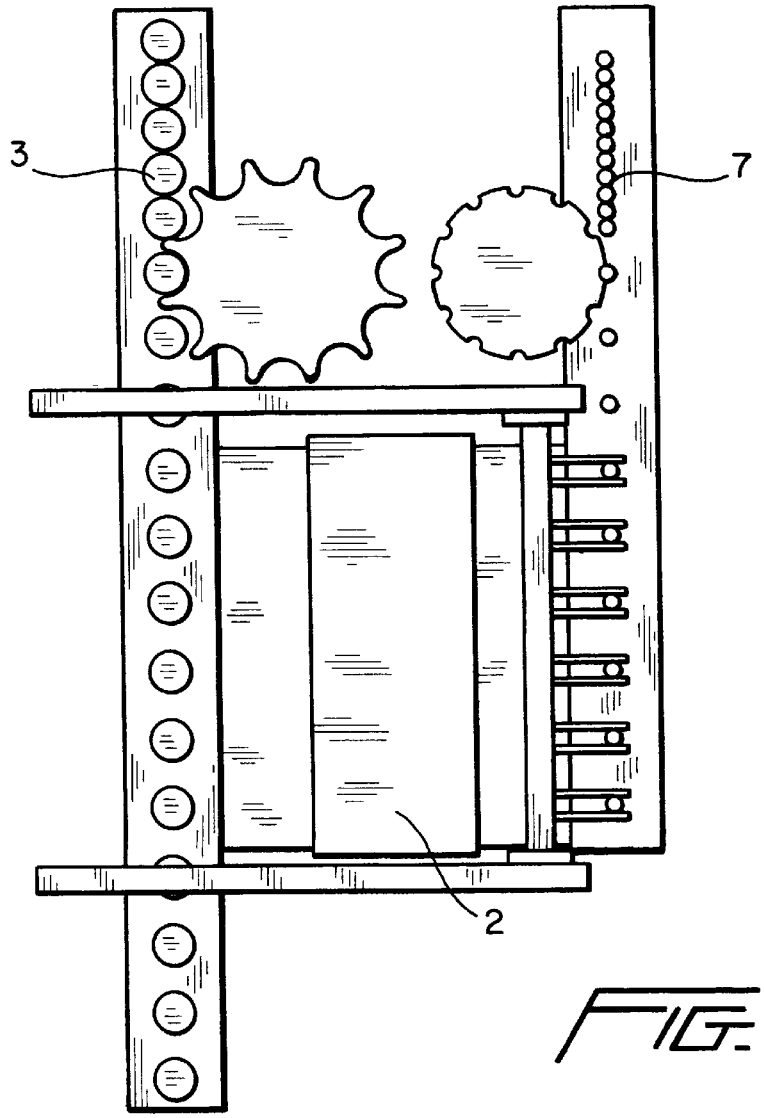
FIG. 6 is a plan view of still another embodiment of the device in accordance with the invention.

FIGS. 6 and 7 show an embodiment in which a linear arrangement of the candle blanks, glasses and the heating plate is utilized. The candle blanks are transported from the candle accumulating belt to the belt 12, in this example, via a linear carrier which grips the blanks, guides them over a heating plate 2 and inserts them on the container belt 12 by means of a cylinder 7, for which candles and containers are brought via an index plate to the same distance on the belts.

What is claimed is:

1. Device for producing a candle surrounded by a container, comprising:

means for linearly supplying multiple empty containers and multiple candle blanks at one time from a supply thereof to an insertion position wherein the candle blanks are smaller than an interior of the containers, heating means extending from a position proximate to the supply of candle blanks to a position prior to said insertion position and arranged to heat a bottom of multiple candle blanks as they are supplied to said insertion position, means for simultaneously inserting multiple candle blanks individually into multiple containers and affixing the heated bottom of each candle blank on the bottom of a container, an intermediate space being formed between the candle blank and an inside wall of the container, and means for filling said intermediate space with liquid candle material.

2. Device as claimed in claim 1, wherein the means for supplying containers and candle blanks comprises two intersecting linear carriers and an indexing means to accurately position and move the multiple candle blanks and multiple containers to the insertion position, and the heating means being arranged such that multiple candle blanks are moved with their bottom over the heating means before they reach the insertion position.

3. Device as claimed in claim 2, wherein the heating means is a heating plate.

4. Device as claimed in claim 3, including means for moving the heating plate into and out of a path of the candle blanks.

* * * * *